US011293698B2

(12) United States Patent
Goldsmith, Jr. et al.

(10) Patent No.: US 11,293,698 B2
(45) Date of Patent: Apr. 5, 2022

(54) SPLIT BAY FORCED DRAFT AIR-COOLED HEAT EXCHANGER

(71) Applicant: Hudson Products Corporation, Ball Ground, GA (US)

(72) Inventors: James D. Goldsmith, Jr., Katy, TX (US); Timothy L. Pearce, Jr., Sugar Land, TX (US)

(73) Assignee: Hudson Products Corporation, Ball Ground, GA (US)

( * ) Notice: Subject to any disclaimer, the term of this patent is extended or adjusted under 35 U.S.C. 154(b) by 0 days.

(21) Appl. No.: 16/836,204

(22) Filed: Mar. 31, 2020

(65) Prior Publication Data

US 2020/0309461 A1 Oct. 1, 2020

Related U.S. Application Data

(60) Provisional application No. 62/827,599, filed on Apr. 1, 2019.

(51) Int. Cl.

| | |
|---|---|
| ***F24H 3/02*** | (2022.01) |
| ***F28D 1/04*** | (2006.01) |
| ***F28D 1/02*** | (2006.01) |

(52) U.S. Cl.

CPC ..... *F28D 1/0435* (2013.01); *F28D 1/024* (2013.01)

(58) Field of Classification Search

CPC ..... F28D 1/0435; F28D 1/024
USPC ..... 165/121
See application file for complete search history.

(56) References Cited

U.S. PATENT DOCUMENTS 3,447,598 A * 6/1969 Kaess, Jr. ..... F28F 9/013 165/67
8,188,698 B2 * 5/2012 Rollins ..... F04D 27/001 318/400.41

* cited by examiner

*Primary Examiner* — Davis D Hwu
(74) *Attorney, Agent, or Firm* — Cook Alex Ltd.

(57) ABSTRACT

A split bay forced draft air-cooled heat exchanger includes first and second bay sub-assemblies. Each sub-assembly includes a tube bundle, a plenum half positioned under the tube bundle and base beams supporting the tube bundle and the plenum half. Also included is a fan assembly having a fan, a fan motor and a drive assembly and a machinery mount upon which the fan assembly is mounted. The machinery mount is attached to base beams of the first bay sub-assembly and is configured to removably attach to base beams of the second sub-assembly with the fan configured to force air into a plenum made up of the plenum halves and across the tube bundles.

17 Claims, 7 Drawing Sheets

SPLIT BAY FORCED DRAFT AIR-COOLED HEAT EXCHANGER

CLAIM OF PRIORITY

This application claims the benefit of U.S. Provisional Application No. 62/827,599, filed Apr. 1, 2019, the contents of which are hereby incorporated by reference.

FIELD OF THE INVENTION

The present disclosure relates generally to forced draft air-cooled heat exchangers and, more specifically, to forced draft air-cooled heat exchangers with a split bay design.

BACKGROUND

Heat exchangers are widely used for cooling or heating process fluid streams using a second cooling or heating fluid stream. Air-cooled heat exchangers, as the name implies, use air as the second cooling fluid and typically employ a fan to drive the air over tube bundles through which the process fluids being cooled flow. Such heat exchangers may be of the induced draft exchanger type or the forced draft exchanger type. Induced draft exchangers feature tube bundle(s) located on the suction side of the fan (with the fan typically positioned above the bundle). Forced draft exchangers feature tube bundle(s) located on the discharge side of the fan (with the fan typically positioned below the bundle). The tube bundles in both types of designs are typically organized in bays with each bay containing one or more tube bundles serviced by one or more fans. Each bay also includes the structure for holding the tube bundle(s) and fan(s), plenum (s) and other attendant equipment.

An example of a prior art forced draft heat exchanger bay is indicated in general at 10 in FIG. 1, and features a fan and plenum below the tube bundle, a fan shaft below the tube bundle and a machinery mount below the tube bundle. More specifically, as illustrated in FIG. 1, the bay 10 includes a fan 12 which is powered by a fan motor and drive assembly 14, which are supported by a machinery mount 15. To focus and direct air flow, a fan ring 16 surrounds the fan and an inlet bell 18 is provided. A tube bundle 22 and a plenum 24 are positioned above the fan, where the latter equalizes air pressure for more even distribution of the air flow from the fan across the tube bundle. A header 25 featuring nozzles 26 directs a process fluid stream into and out of the tube bundle so that the process fluid stream is cooled by the air flow generated by the fan. Column supports 28 support the bay in an installation.

Air-cooled heat exchanger designs are limited to sizes that can be economically transported. Many countries, states or providences have restrictions regarding the width, height and length of equipment that pass through their domain. These restrictions have an impact on the number of air-cooled heat exchanger bays that will be required to do a given duty of an installation.

SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect a split bay forced draft air-cooled heat exchanger features a first bay sub-assembly including a first tube bundle, a first plenum half positioned under the first tube bundle and a plurality of first base beams supporting the first tube bundle and the first plenum half. The heat exchanger also features a second bay sub-assembly including a second tube bundle, a second plenum half positioned under the second tube bundle, a plurality of second base beams supporting the second tube bundle and the second plenum half. The heat exchanger also includes a fan assembly including a fan, a fan motor and a drive assembly. The heat exchanger also includes a machinery mount upon which the fan assembly is mounted. The machinery mount is attached to at least some of the plurality of first base beams and is configured to removably attach to at least some of the plurality of second base beams so that the first and second bay sub-assemblies are secured together with the fan configured to force air into a plenum made up of the first and second plenum halves and across the first and second tube bundles.

In another aspect, a split bay forced draft air-cooled heat exchanger features a first bay sub-assembly including a first tube bundle, a first plenum half positioned under the first tube bundle, a plurality of first column supports connected to the first tube bundle and the first plenum half and a plurality of first base beams positioned one each across bottom portions of at least two pairs of the plurality of first column supports so that the plurality of first base beams and the plurality of first column supports are configured to support the first tube bundle and the first plenum half on a surface. The heat exchanger also has a second bay sub-assembly including a second tube bundle, a second plenum half positioned under the second tube bundle, a plurality of second column supports connected to the second tube bundle and the second plenum half and a plurality of second base beams positioned one each across bottom portions of at least two pairs of the plurality of second column supports so that the plurality of second base beams and the plurality of first column supports are configured to support the first tube bundle and the first plenum half on a surface. The heat exchanger also includes a fan assembly including a fan, a fan motor and a drive assembly and a machinery mount upon which the fan assembly is mounted. The machinery mount is attached to a pair of the plurality of first base beams and is configured to removably attach to a pair of the plurality of second base beams so that the first and second bay sub-assemblies are secured together with the fan configured to force air into a plenum made up of the first and second plenum halves and across the first and second tube bundles.

In still another aspect, a method for transporting a forced draft air-cooled heat exchanger includes the steps of: providing a first bay sub-assembly having a first tube bundle with a first plenum half under the first tube bundle, where the first tube bundle and the first plenum half are supported on a pair of first base beams; providing a second bay sub-assembly having a second tube bundle with a second plenum half under the second tube bundle, where the second tube bundle and the second plenum half are supported on a pair of second base beams; providing a machinery mount upon which is mounted a fan, a fan motor and a drive assembly, wherein said fan includes a plurality of removable blades; removing some of the plurality of removable blades from the fan; transporting the first bay sub-assembly, the second bay sub-assembly, the machinery mount, the fan motor and the removed fan blades.

In still another aspect, a split bay forced draft air-cooled heat exchanger features a first bay sub-assembly including a first tube bundle, a first tube bundle frame within which the first tube bundle is mounted, a first plenum half positioned under the first tube bundle, a first machinery mount positioned under the first plenum half, a first outer support member attached between an outer end of the first machinery mount and the first tube bundle frame and a first inner support member removably attached between an inner end of the first machinery mount and the first tube bundle frame. A second bay sub-assembly includes a second tube bundle, a second tube bundle frame within which the second tube bundle is mounted, a second plenum half positioned under the second tube bundle, a second machinery mount positioned under the second plenum half, a second outer support member attached between an outer end of the second machinery mount and the second tube bundle frame and a second inner support member removably attached between an inner end of the second machinery mount and the second tube bundle frame. A fan assembly includes a fan, a fan motor and a drive assembly. The fan assembly is mounted on the first or second machinery mount. The inner end of the first machinery mount is configured to removably attach to the inner end of the second machinery mount, after the first and second inner support members are detached from the first and second machinery mounts and the first and second tube bundle frames, so that the first and second bay sub-assemblies are secured together with the fan configured to force air into a plenum made up of the first and second plenum halves and across the first and second tube bundles.

DETAILED DESCRIPTION OF EMBODIMENTS

In accordance with the disclosure, embodiments of a forced draft air-cooled heat exchanger featuring a split bay design are provided. Bays are shipped in two separate assemblies and bolted together in the field.

By splitting the bay design into two pieces, a much larger bay may be manufactured because the bay can be fabricated and shipped in two assemblies that share common fans and mechanical drives across the width of the bay. For example, instead of providing two bays with three (3) fans and mechanical drives each (a total of six fans and six mechanical drives), a manufacturer can design and fabricate one large bay fabricated in two assemblies with up to three (3) large fans and three (3) mechanical drives for the single larger bay. As an example only, using the technology of the disclosure, it is plausible to design a unit 33' wide×70' long and use only two fans and two mechanical drives. This gives a manufacturer a competitive advantage to be able to supply one larger bay in place of two smaller bays at a competitive price without the use of offshore suppliers.

Embodiments of the heat exchanger of the disclosure are specifically designed to provide support for the weight of the entire sub-assembly (half of the bay). It allows for the machinery mount (structure that includes the motor, sprockets, belt, bearings, or motor/gearbox/gearmotor, and fan shafts) to be installed on one half of the bay to later be bolted to the second half of the bay. The structure of the unit is designed to also act as the structural members to support the unit during shipping without the need to add shipping beams that are later discarded at the job site.

Figure 1:
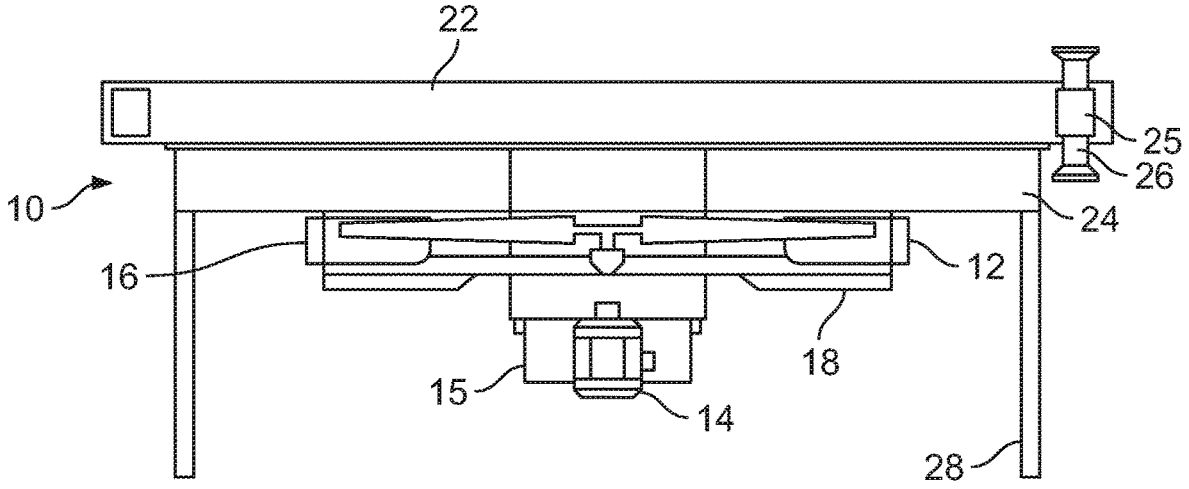
FIG. 1 (Prior Art)
FIG. 1 is a side elevational view of a prior art forced draft heat exchanger bay.
Figure 2:
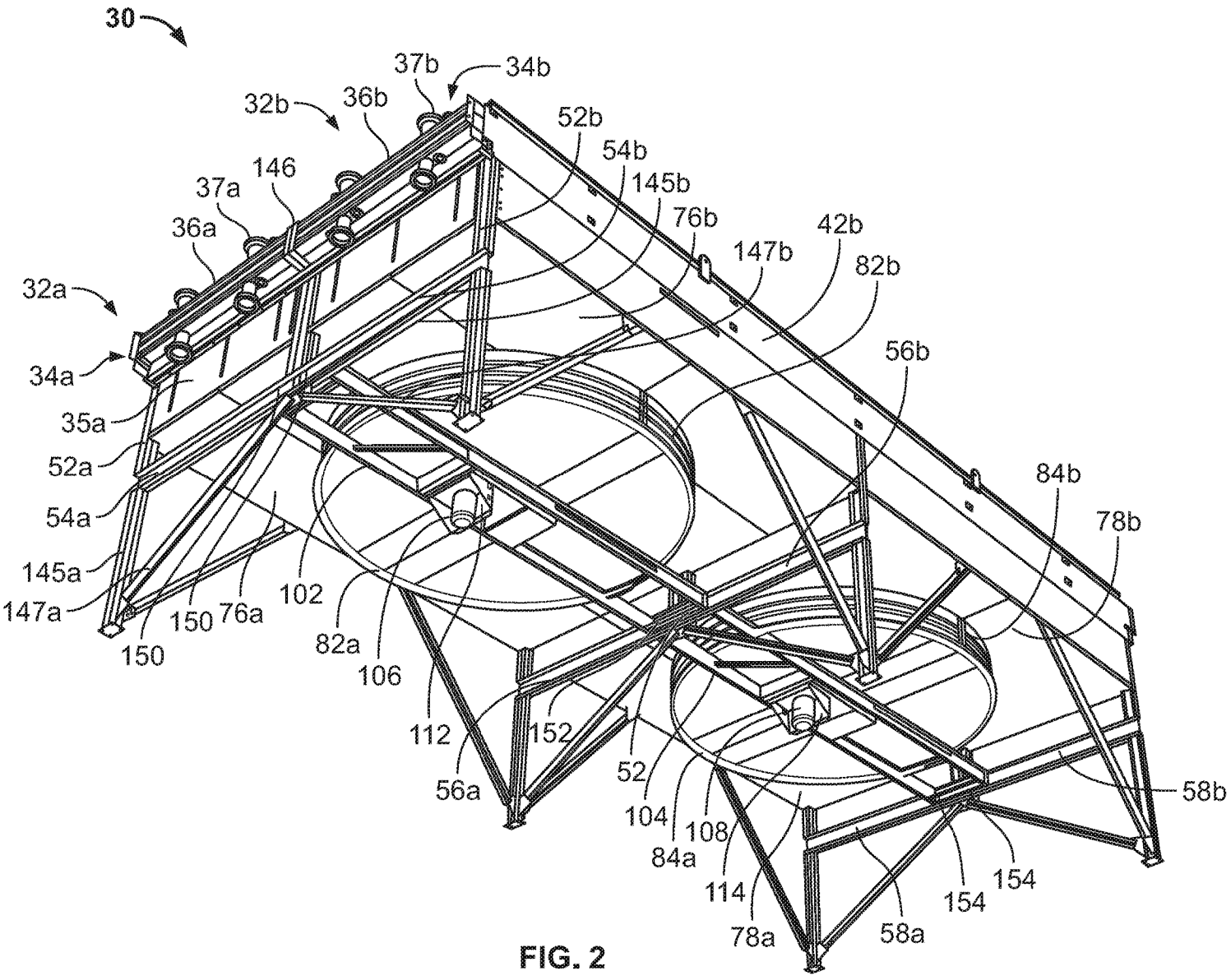
FIG. 2 is a bottom perspective view of an embodiment of the split bay forced draft air-cooled heat exchanger of the disclosure after assembly with the fans omitted.
Figure 3:
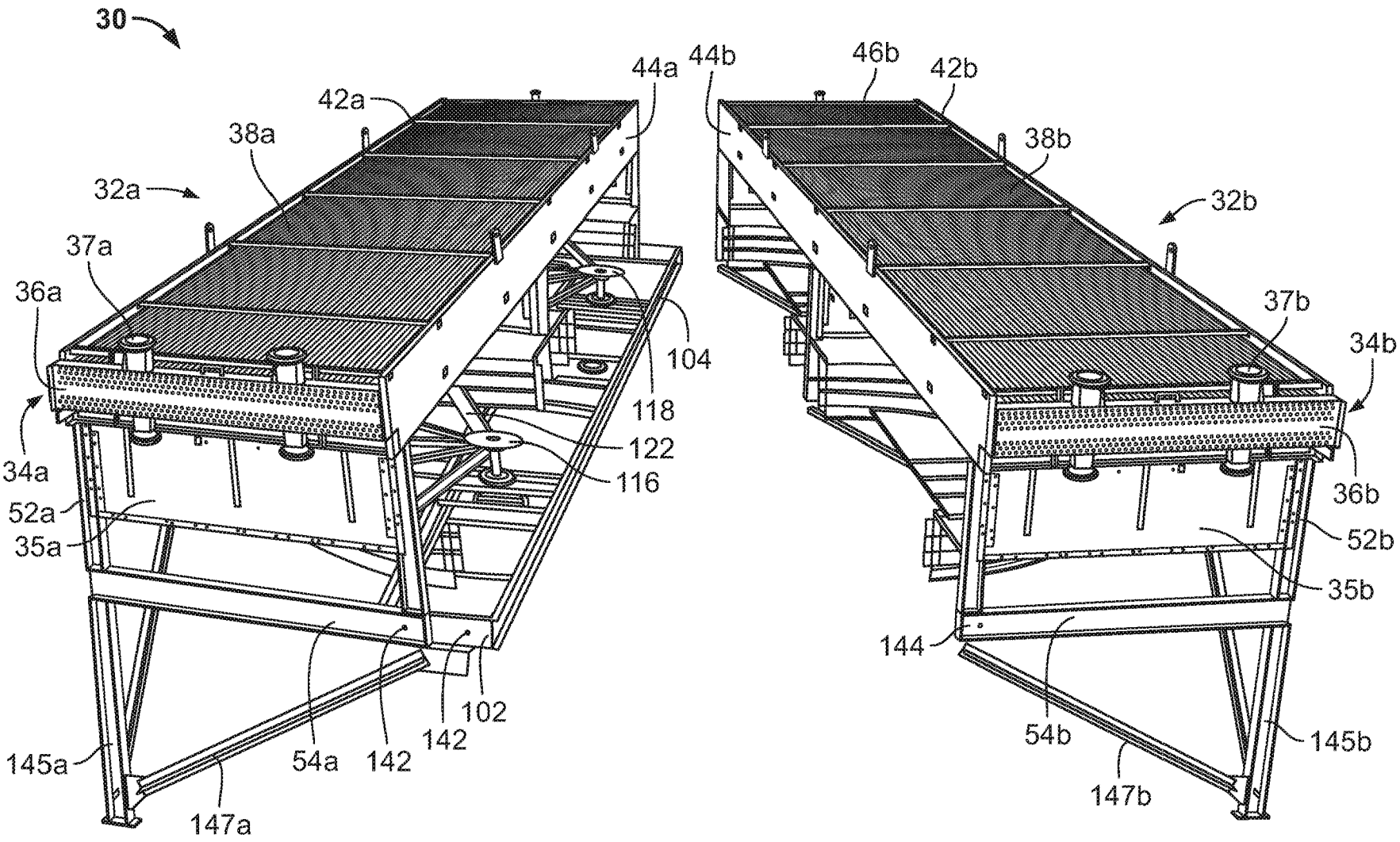
FIG. 3 is a top perspective view of the split bay forced draft air-cooled heat exchanger of FIG. 2 with the fans, fan motors and associated drive assemblies installed but prior to assembly of the bay sub-assemblies.

An embodiment of a split forced draft air-cooled heat exchanger bay is indicated in general at 30 in FIGS. 2 and 3. The fan blades and associated drive components have been omitted from FIG. 2 for clarity. As illustrated in FIGS. 2 and 3, the bay 30 includes a first bay sub-assembly, indicated in general at 32*a*, and a second bay sub-assembly, indicated in general at 32*b*.

First bay sub-assembly 32*a* includes a first tube bundle, indicated in general at 34*a*, positioned above a first plenum half 35*a*. First tube bundle includes headers 36*a* (FIGS. 2 and 3) and 46*a* (FIG. 3) having inlet and outlets, such as nozzles 37*a*, for the process fluid being cooled and a number of tubes 38*a* running between the headers 36*a* and 46*a*. As known in the art, each of the tubes 38*a* has an inlet and an outlet in fluid communication with the headers 36*a* and 46*a* so that process fluid entering the inlets of one of the headers flows through the tubes and exits the outlets of the other header. Alternative tube and header configurations known in the art may be used in place of the tubes 38*a* and headers 36*a* and 46*a* including, but not limited to, U-shaped and serpentine tubes.

As illustrated in FIG. 3, the tube bundle 34*a* includes a pair of elongated side plates 42*a* and 44*a* that support the headers 36*a* and 46*a* and tubes 38*a* that form the tube bundle 34*a*. The tube bundle 34*b* features a construction similar to tube bundle 34*a* and includes headers 36*b* and 46*b* and tubes 38*b* as well as a tube bundle frame formed by elongated side plates 42*b* and 44*b* as well as the headers 36*b* and 46*b*.

As illustrated in FIGS. 2 and 3, the frame of tube bundle 34*a* is mounted to the top ends of column supports 52*a*. While three pairs of the column supports 52*a* (six individual column supports) are illustrated, an alternative number may be used. The bottom ends of the pairs of the column supports 52*a* are mounted upon base beams 54*a*, 56*a* and 58*a* (FIG. 2). The frame of tube bundle 34*b* is similarly mounted to the tops of column supports 52*b*, with the bottoms of the column supports 52*b* mounted upon base beams 54*b*, 56*b* and 58*b* (FIG. 2).

Figure 4:
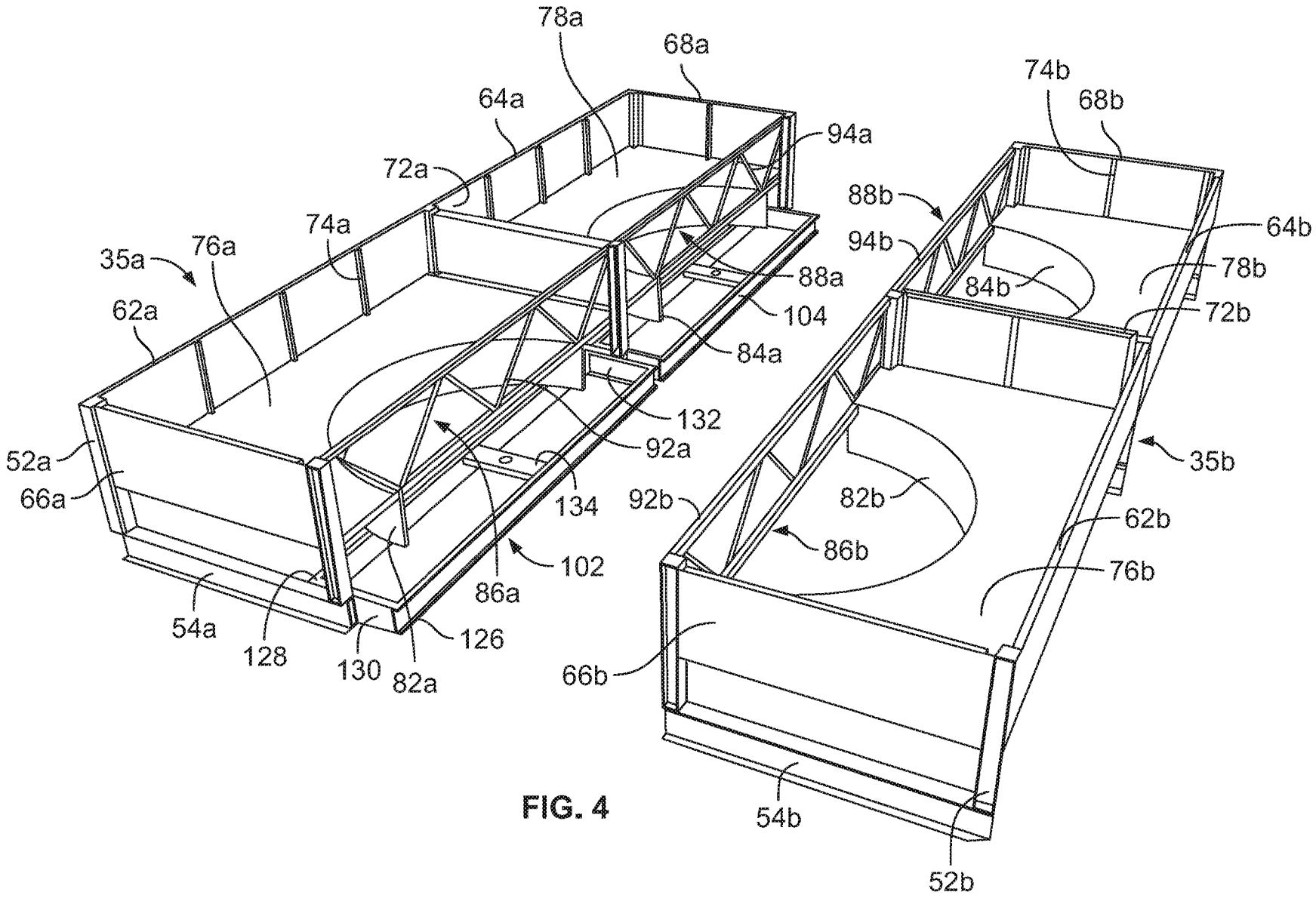
FIG. 4 is a top perspective view of the unassembled bay sub-assemblies of FIG. 3 with the tube bundles and fans, fan motors and associated drive assemblies omitted.

As examples only, and as illustrated in FIGS. 2-4, the column supports 52*a* and 52*b*, and the base beams 54*a*, 56*a*, 58*a* and 54*b*, 56*b*, 58*b* may be steel I-beams. Alternative types of beams or members and materials known in the art may be used instead.

As best illustrated in FIG. 4, where first plenum half is indicated in general at 35*a*, the first plenum half includes sidewalls 62*a* and 64*a* which extend between three of the column supports 52*a*. The first plenum half 35*a* also includes a pair of end walls 66*a* and 68*a* that extend between corresponding pairs of column supports and a divider wall 72*a* that extends between a corresponding pair of column supports. Each wall may optionally be provided with support members 74*a*. Floor panels 76*a* and 78*a* are joined to the bottom ends of corresponding side, end and divider walls, as shown in FIG. 4, and each includes a semi-circular fan opening bordered by a downward extending fan ring half circle 82*a* and 84*a*.

First plenum half end walls 66*a* and 68*a*, divider wall 72*a*, floor 76*a* and floor 78*a* define open sides indicated in general at 86*a* and 88*a*. A pair of structural supports 92*a* and 94*a* traverses the open sides 86*a* and 88*a*, respectively, and support the first plenum half 35*a* and half circle of the fan ring during both operation and in transit. As an example only, and as illustrated, the structural supports 92*a* and 94*a* may include a truss structure.

With continued reference to FIG. 4, the second plenum half 35*b* includes sidewalls 62*b* and 64*b* which extend between three of the column supports 52*b*. The second plenum half 35*b* also includes a pair of end walls 66*b* and 68*b* that extend between corresponding pairs of column supports and a divider wall 72*b* that extends between a corresponding pair of column supports. Each wall may optionally be provided with support members 74*b*. Floor panels 76*b* and 78*b* are joined to the bottom ends of corresponding side, end and divider walls, as shown in FIG. 4, and each includes a semi-circular fan opening bordered by a downward extending fan ring half 82*b* and 84*b*.

Second plenum half end walls 66*b* and 68*b*, divider wall 72*b*, floor 76*b* and floor 78*b* define open sides indicated in general at 86*b* and 88*b*. A pair of structural supports 92*b* and 94*b* traverses the open sides 86*b* and 88*b*, respectively, and support the first plenum half 35*b* and half circle of the fan ring in both operation and in transit. As an example only, and as illustrated, the structural supports 92*b* and 94*b* may include a truss structure.

While the first and second plenum halves 35*a* and 35*b* each feature a single dividing wall and two semi-circular fan openings, the dividing walls may be omitted or additional dividing walls may be included and an alternative number of semi-circular fan openings (and associated half circle fan rings), including one or more than two, may be present in a single plenum half.

The plenum half sidewalls, end walls, dividing walls and floors and the fan rings are each preferably made of sheet metal (although other materials may be used).

With reference to FIGS. 2 and 3, first bay sub-assembly 32*a* features a pair of machinery mounts 102 and 104 upon which fan motors 106 and 108 (FIG. 2) are mounted via motor brackets 112 and 114, respectively. In addition, fan hubs 116 and 118 (FIG. 3) are rotationally mounted to the machinery mounts 102 and 104, respectively. The fan hubs 116 and 118 receive fan blades 122 and 124, respectively and are turned by the fan motors 106 and 108 using drive assemblies that are also mounted on the machinery mounts 102 and 104. Such drive assemblies are well known in the art and may include, as examples only, sprockets and chains, belts and/or drive shafts.

As illustrated in FIG. 4, machinery mount 102 includes a pair of elongated and opposing side beams 126 and 128 and opposing end beams 130 and 132, as well as a cross member 134. The cross member 134 includes an opening to which the fan hub may be rotationally mounted. Machinery mount 104 features a similar structure.

As illustrated in FIGS. 2-4, each of the machinery mounts 102 and 104 is designed to run lengthwise along the assembly of one-half of the bay. There is one machinery mount per fan, with the machinery mounts arranged end to end.

The length of the installed machinery mounts span the entire length of the bay, as illustrated in FIGS. 2 and 3, because the machinery mount cannot be supported by the tube bundles. This is because any support suspending from the bundles would interfere with the fans' operation. Furthermore, a machinery mount designed for the full width of the bay would defeat the purpose of minimizing the width of an assembly for shipment.

The three base beams 54*a*, 56*a* and 58*a* at the bottom of the first bay sub-assembly 32*a* and the three base beams 54*b*, 56*b* and 58*b* at the bottom of the second bay sub-assembly 32*b* each feature fastener openings (for example, 140, 142 and 144 in FIG. 3) that align with fastener openings formed in the end beams of the machinery mounts 102 and 104 when the bay sub-assemblies are joined in the manner shown in FIG. 2. In a preferred embodiment, bolts pass through the fastener openings of the base beams and the machinery mounts to secure the two bay sub-assemblies 32*a* and 32*b* together (FIG. 2).

As a result, the two bay sub-assembly halves 32*a* and 32*b* are bolted together by bolted connections, such as at the locations indicated by arrows 150, 152 and 154 in FIG. 2, and the machinery mounts 102 and 104 are secured to each bay sub-assembly half in a manner that provides the rigidity necessary to prevent vibration issues with the bay. In addition, the abutting flanges of adjacent column supports are bolted, or otherwise secured, together. Angle brackets may be positioned on the inwardly facing edges of each of the floor panels 76*a*, 76*b*, 78*a* and 78*b* and bolted, or otherwise secured, together to aid in securing the two bay sub-assembly halves together. Angle brackets may also be positioned on the ends of each of the fan ring half circles 82*a*, 82*b*, 84*a* and 84*b* and bolted, or otherwise secured, together to aid in securing the two bay sub-assembly halves together. In alternative embodiments, the base beams may feature face plates abutting one another when the sub-assembly halves are positioned together as shown in FIG. 2, with fasteners such as bolts securing the face plates, and thus the end-to-end base beams, together. Assembly of the bay sub-assemblies 32*a* and 32*b*, as illustrated in FIG. 2, results in two circular fan openings being formed and bordered by two completed fan rings formed from the joined fan ring circle halves 82*a* and 82*b* and 84*a* and 84*b*. In addition, the joined plenum halves 35*a* and 35*b* form dedicated plenums for each of the fan openings. Alternative embodiments may provide an alternative number of fan openings and plenums.

As illustrated in FIGS. 2 and 3, the base beams of bay sub-assembly 32*a* may be supported by legs 145*a*, and corresponding struts 147*a*, while the base beams of sub-assembly 32*b* may similarly be supported by legs 145*b* and corresponding struts 147*b*.

In embodiments where a truss (FIG. 4 at 92*a*, 92*b* and 94*a* and 94*b*) is provided for the plenum halves, the need for an air seal between the two assembled bay sub-assembly halves, at the location indicated by arrow 146 of FIG. 2, may be avoided. Such an air seal, however, may optionally be provided.

Prior to shipping, the bay sub-assembly 32*a* with the machinery mounts 102 and 104 will have the fans mounted with half of the fan blades removed (as illustrated in FIG. 3), with the fan blades to be installed at the job site. Furthermore, the fan motors (106 and 108 of FIG. 3) may will be removed for shipping. In alternative embodiments, the fan motors may remain installed for shipping.

The base beams (54*a*, 54*b*, 56*a*, 56*b* and 58*a* and 58*b* of FIG. 2) remain part of the assembled unit and also act as shipping beams for transit of the bay sub-assemblies 32*a* and 32*b*.

Figure 5:
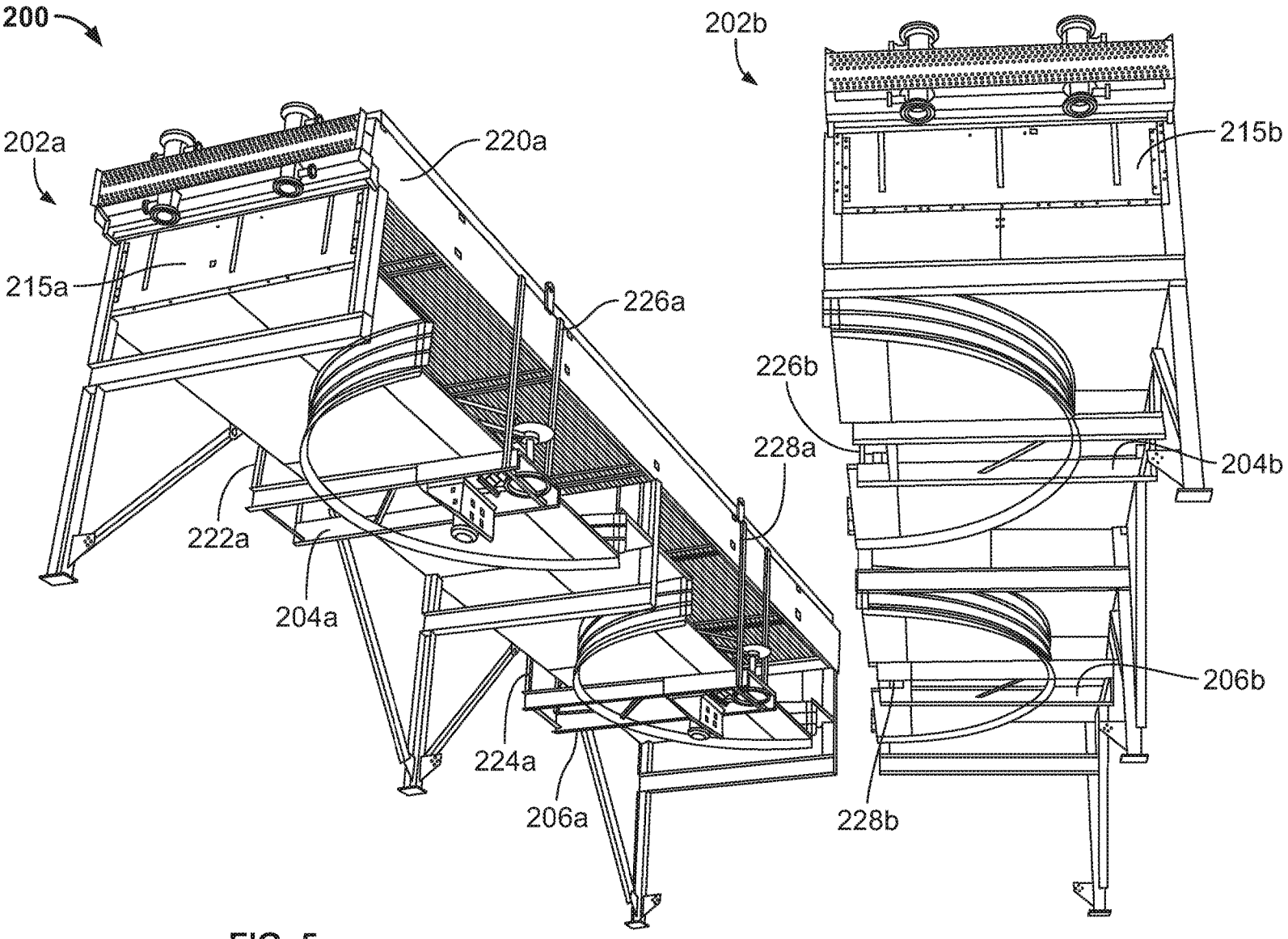
FIG. 5 is a bottom perspective view of an alternative embodiment of the split bay forced draft air-cooled heat exchanger of the disclosure featuring a perpendicular machinery mount prior to assembly of the bay sub-assemblies.
Figure 6:
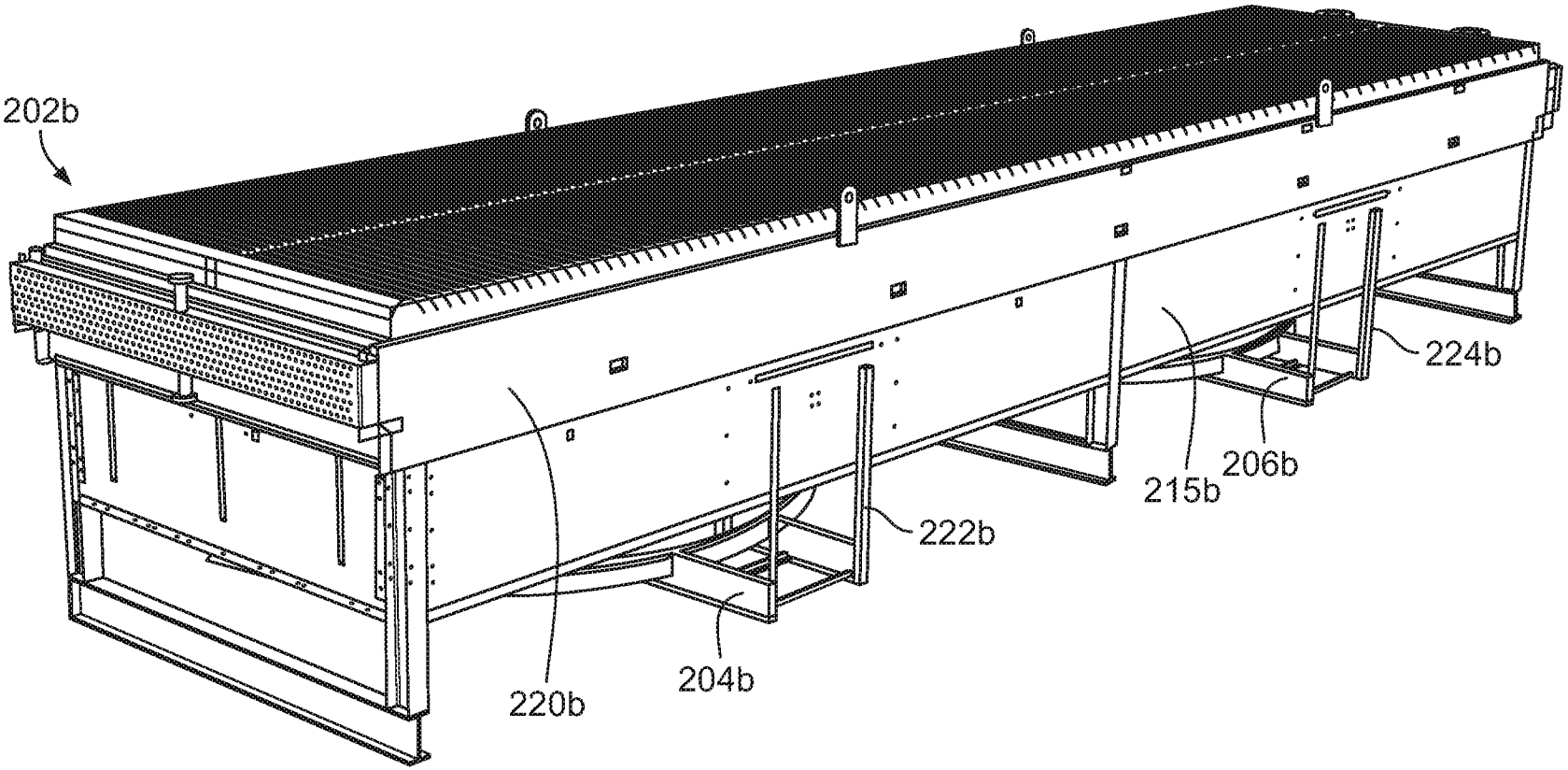
FIG. 6 is a right-side perspective view of one of the bay sub-assemblies of the split bay forced draft air-cooled heat exchanger of FIG. 5.
Figure 7:
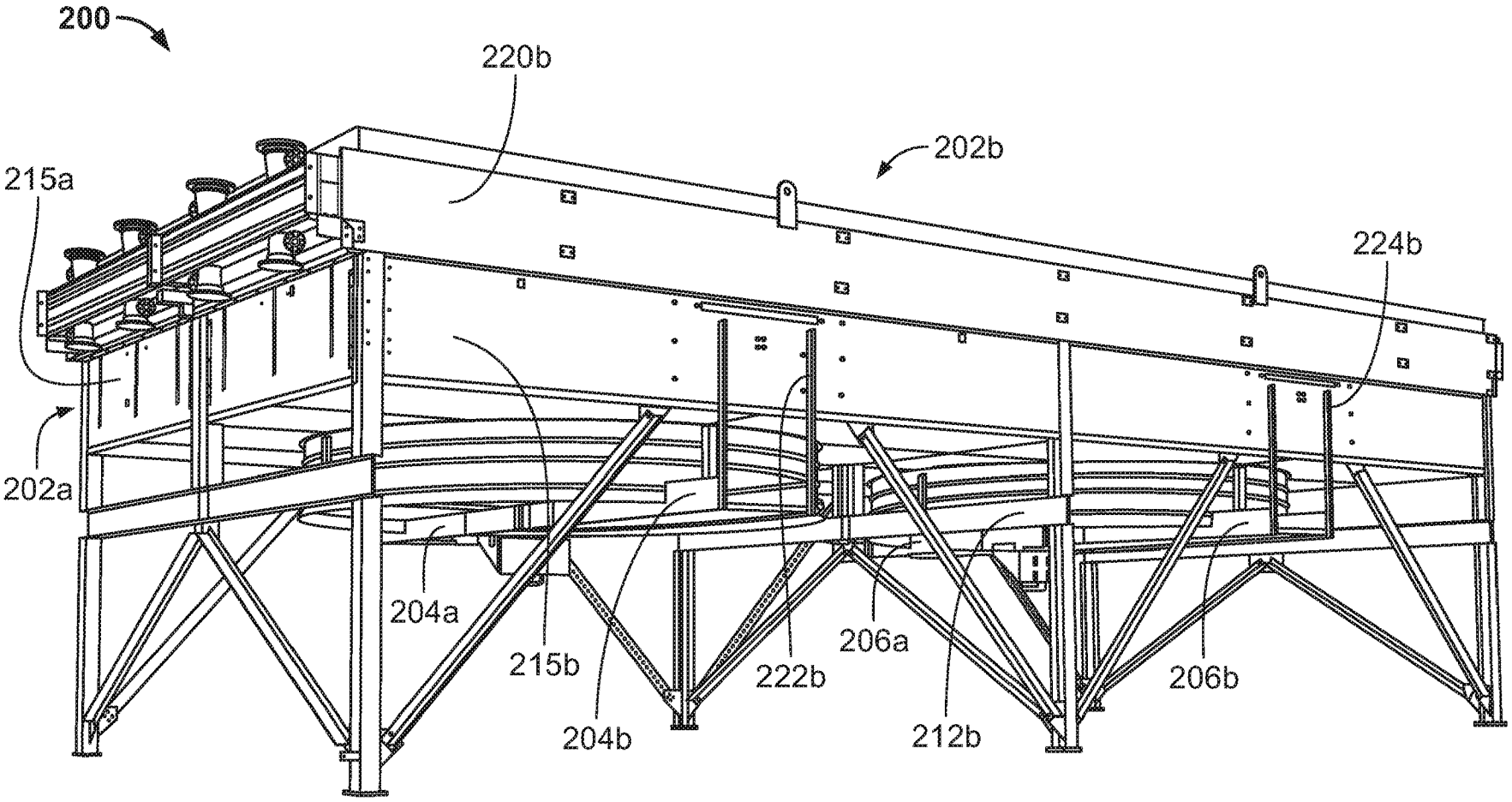
FIG. 7 is a right-side perspective view of the split bay forced draft air-cooled heat exchanger of FIG. 5 after assembly.

An alternative embodiment of a split forced draft air-cooled heat exchanger bay of the disclosure is indicated in general at 200 in FIGS. 5 and 7. The bay 200 includes a first bay sub-assembly, indicated in general at 202*a* (FIGS. 5 and 7), and a second bay sub-assembly, indicated in general at 202*b* (FIGS. 5-7).

The primary difference between the embodiment of FIGS. 5-7 and the embodiments described above is that the machinery mounts 204*a*, 206*a*, 204*b* and 206*b* run perpendicular to the length (i.e. across the width) of each bay sub-assembly. Given that the remaining components of each bay sub-assembly are the same as described above in previous embodiments, they will not be numbered in, and described with regard to, FIGS. 5-7.

First bay sub-assembly 202*a* features a pair of machinery mounts 204*a* and 206*a*. Second bay sub-assembly 202*b* features a pair of machinery mounts 204*b* and 206*b*. Fan assemblies, including fans, fan motors and associated drive systems, are mounted on machinery mounts 204*b* and 206*b*.

The machine mounts 204*a* and 206*a* are supported at their outer ends by the sidewall of the plenum 215*a* via outer support members 222*a* and 224*a* (FIG. 5). Outer support members 222*a* and 224*a* may be attached to the plenum directly (as illustrated) or alternatively via attachment to the tube bundle frame 220*a*. The inner ends of machine mounts 204*a* and 206*a* are supported by the tube bundle frame 220*a* by inner support members 226*a* and 228*a* (FIG. 5).

The machine mounts 204*b* and 206*b* are supported at their outer ends by the sidewall of plenum 215*b* via outer support members 222*b* and 224*b* (FIGS. 6 and 7). Outer support members 222*b* and 224*b* may be attached to the plenum directly (as illustrated) or alternatively via attachment to the tube bundle frame 220*b*. The inner ends of machine mounts 204*b* and 206*b* are supported by inner support members 226*b* and 228*b* (FIG. 5) by tube bundle frame 220*b* (FIGS. 6 and 7).

The inner and outer support members of FIGS. 5-7 may be elongated plates, I-beams, trusses or any other structural members or assemblies known in the art and may be constructed of, as an example only, steel or any other high-strength and durable material.

The inner and outer support members secure the components of each sub-assembly 202*a* and 202*b* together during shipping, which occurs when the bay sub-assemblies are in the configurations illustrated in FIG. 5. The inner support members 226*a*, 228*a*, 226*b* and 228*b* are removed at the job site, so that the two bay sub-assemblies 202*a* and 202*b* may be joined in the manner illustrated in FIG. 7. The outer support members 222*a*, 224*a*, 222*b* and 224*b* remain installed after assembly, as illustrated in FIG. 7.

The bay sub-assemblies are joined together in the configuration illustrated in FIG. 7 by joining the inner ends of machinery mounts 204*a* and 204*b* together and the inner ends of machinery mounts 206*a* and 206*b* together. This may be accomplished by providing the inner ends of the machinery mounts with face plates or cross members and then bolting the opposing face plates or cross members together. Alternatively, brackets and bolts or other fastening arrangements and/or fasteners known in the art may be used. The remaining portions of the bay sub-assemblies are secured together as well using the fastening arrangements described for the above embodiments.

As illustrated in FIG. 7, when the bay sub-assemblies are assembled to form the complete bay, the machinery mounts joined end to end run across the width of the entire bay. There is one fan assembly per joined machinery mount pair.

Embodiments of the disclosure provide forced draft air-cooled heat exchanger bay sub-assemblies that have the structural integrity necessary to provide support during transportation. The embodiments support the plenum and fan ring, as well as the fan and mechanical drive system, both during shipping and operation.

While the preferred embodiments of the disclosure have been shown and described, it will be apparent to those skilled in the art that changes and modifications may be made therein without departing from the spirit of the disclosure, the scope of which is defined by the following claims.

What is claimed is:

1. A split bay forced draft air-cooled heat exchanger comprising:

a. a first bay sub-assembly including:
   i) a first tube bundle;
   ii) a first plenum half positioned under the first tube bundle;
   iii) a plurality of first base beams supporting the first tube bundle and the first plenum half, wherein the first tube bundle and the first plenum half are mounted to the plurality of first base beams by a plurality of first column supports;

b. a second bay sub-assembly including:
   i) a second tube bundle;
   ii) a second plenum half positioned under the second tube bundle;
   iii) a plurality of second base beams supporting the second tube bundle and the second plenum half, wherein the second tube bundle and the second plenum half are mounted to the plurality of second base beams by a plurality of second column supports;

c. a fan assembly including a fan, a fan motor and a drive assembly;

d. a machinery mount upon which the fan assembly is mounted, said machinery mount attached to at least some of the plurality of first base beams and configured to removably attach to at least some of the plurality of second base beams so that the first and second bay sub-assemblies are secured together with the fan configured to force air into a plenum made up of the first and second plenum halves and across the first and second tube bundles.

2. The heat exchanger of claim 1 wherein the first tube bundle includes a first tube bundle frame that is supported by the plurality of first column supports and the second tube bundle includes a second tube bundle frame that is supported by the plurality of second column supports.

3. The heat exchanger of claim 1 wherein the machinery mount is also removably attached to at least some of the plurality of first base beams.

4. The heat exchanger of claim 1 wherein the first plenum half includes a semi- circular first fan opening bordered by a downward extending first fan ring half circle and the second plenum half includes a semi-circular second fan opening bordered by a downward extending second fan ring half circle.

5. A split bay forced draft air-cooled heat exchanger comprising:

a. a first bay sub-assembly including:
i) a first tube bundle;
ii) a first plenum half positioned under the first tube bundle, wherein the first plenum half includes a first open side and further comprising a first structural support traversing the first open side;
iii) a plurality of first base beams supporting the first tube bundle and the first plenum half;
b. a second bay sub-assembly including:
i) a second tube bundle;
ii) a second plenum half positioned under the second tube bundle, wherein the second plenum half includes a second open side and further comprising a second structural support traversing the second open side;
iii) a plurality of second base beams supporting the second tube bundle and the second plenum half;
c. a fan assembly including a fan, a fan motor and a drive assembly;
d. a machinery mount upon which the fan assembly is mounted, said machinery mount attached to at least some of the plurality of first base beams and configured to removably attach to at least some of the plurality of second base beams so that the first and second bay sub-assemblies are secured together with the fan configured to force air into a plenum made up of the first and second plenum halves and across the first and second tube bundles.

6. The heat exchanger of claim 5 wherein each of the first and second structural supports includes a truss.

7. A split bay forced draft air-cooled heat exchanger comprising:
a. a first bay sub-assembly including:
i) a first tube bundle;
ii) a first plenum half positioned under the first tube bundle;
iii) a plurality of first column supports connected to the first tube bundle and the first plenum half;
iv) a plurality of first base beams positioned one each across bottom portions of at least two pairs of the plurality of first column supports so that the plurality of first base beams and the plurality of first column supports are configured to support the first tube bundle and the first plenum half on a surface;
b. a second bay sub-assembly including:
i) a second tube bundle;
ii) a second plenum half positioned under the second tube bundle;
iii) a plurality of second column supports connected to the second tube bundle and the second plenum half;
iv) a plurality of second base beams positioned one each across bottom portions of at least two pairs of the plurality of second column supports so that the plurality of second base beams and the plurality of first column supports are configured to support the first tube bundle and the first plenum half on a surface;
c. a fan assembly including a fan, a fan motor and a drive assembly;
d. a machinery mount upon which the fan assembly is mounted, said machinery mount attached to a pair of the plurality of first base beams and configured to removably attach to a pair of the plurality of second base beams so that the first and second bay sub-assemblies are secured together with the fan configured to force air into a plenum made up of the first and second plenum halves and across the first and second tube bundles.

8. The heat exchanger of claim 7 wherein the first tube bundle includes a first tube bundle frame that is supported by the plurality of first column supports and the second tube bundle includes a second tube bundle frame that is supported by the plurality of second column supports.

9. The heat exchanger of claim 7 wherein the machinery mount is also removably attached to a pair of the plurality of first base beams.

10. The heat exchanger of claim 7 wherein the first plenum half includes a semi- circular first fan opening bordered by a downward extending first fan ring half circle and the second plenum half includes a semi-circular second fan opening bordered by a downward extending second fan ring half circle.

11. The heat exchanger of claim 7 wherein the first plenum half includes a first open side and the second plenum half includes a second open side and further comprising a first structural support traversing the first open side and a second structural support traversing the second open side.

12. The heat exchanger of claim 11 wherein each of the first and second structural supports includes a truss.

13. A split bay forced draft air-cooled heat exchanger comprising:
a. a first bay sub-assembly including:
i) a first tube bundle;
ii) a first tube bundle frame within which the first tube bundle is mounted;
iii) a first plenum half positioned under the first tube bundle;
iv) a first machinery mount positioned under the first plenum half;
v) a first outer support member attached to an outer end of the first machinery mount and the first plenum half;
vi) a first inner support member removably attached to an inner end of the first machinery mount and the first tube bundle frame;
b. a second bay sub-assembly including:
i) a second tube bundle;
ii) a second tube bundle frame within which the second tube bundle is mounted;
iii) a second plenum half positioned under the second tube bundle;
iv) a second machinery mount positioned under the second plenum half;
v) a second outer support member attached to an outer end of the second machinery mount and the second plenum half;
vi) a second inner support member removably attached to an inner end of the second machinery mount and the second tube bundle frame;
c. a fan assembly including a fan, a fan motor and a drive assembly, said fan assembly mounted on the first or second machinery mount;
d. said inner end of the first machinery mount configured to removably attach to the inner end of the second machinery mount, after the first and second inner support members are detached from the first and second bay sub-assemblies, so that the first and second bay sub-assemblies are secured together with the fan configured to force air into a plenum made up of the first and second plenum halves and across the first and second tube bundles.

14. The heat exchanger of claim 13 wherein each of the first and second tube bundle frames includes a pair of elongated side plates to which the inner support members are attached.

15. The heat exchanger of claim 14 wherein the pair of elongated side plates are joined by a pair of tube bundle headers.

16. The heat exchanger of claim 13 wherein the first and second outer support members are attached directly to the first and second plenum halves, respectively.

17. The heat exchanger of claim 13 wherein the first and second outer support members are attached to the first and second tube bundle frames, respectively.

* * * * *